US005417474A

United States Patent [19]

Golynsky

[11] Patent Number: 5,417,474

[45] Date of Patent: May 23, 1995

[54] TILT CONTROL MECHANISM FOR CHAIRS

[75] Inventor: Arkady Golynsky, Allentown, Pa.

[73] Assignee: Westinghouse Electric Corporation, Pittsburgh, Pa.

[21] Appl. No.: 125,233

[22] Filed: Sep. 23, 1993

[51] Int. Cl.[6] ..... A47C 3/03

[52] U.S. Cl. ..... 297/302; 297/328

[58] Field of Search ..... 297/302, 303, 327, 328, 297/313

[56] References Cited

U.S. PATENT DOCUMENTS

| | | | |
|---|---|---|---|
| 208,000 | 9/1878 | Tripp | 297/327 |
| 215,075 | 5/1879 | Starr | 297/327 |
| 218,972 | 8/1879 | Hollstegge et al. | 297/328 |
| 1,788,113 | 1/1931 | Leach | 297/328 |
| 2,319,700 | 5/1943 | Miller et al. | 297/328 |
| 2,771,124 | 11/1956 | Borsani | 297/313 |
| 3,043,624 | 7/1962 | Mason | 297/303 |
| 3,198,575 | 8/1965 | Hawkins | 297/328 |
| 4,384,741 | 5/1983 | Flum et al. | 297/328 |
| 4,640,548 | 2/1987 | Desanta . | |
| 4,720,071 | 1/1988 | Nelson et al. . | |
| 4,796,950 | 1/1989 | Mrotz et al. . | |
| 4,818,019 | 4/1989 | Mrotz . | |
| 4,858,993 | 8/1989 | Steinmann . | |
| 4,889,384 | 12/1989 | Sulzer . | |
| 4,943,115 | 7/1990 | Stucki . | |
| 5,029,940 | 7/1991 | Golynsky et al. . | |

FOREIGN PATENT DOCUMENTS

| | | | |
|---|---|---|---|
| 3616475 | 6/1987 | Germany | 297/302 |

*Primary Examiner*—Richard A. Bertsch
*Assistant Examiner*—Roland G. McAndrews, Jr.

[57] ABSTRACT

Disclosed is a tilt control mechanism for a knee tilt chair that permits the chair to be locked in a number of intermediate tilt positions, as well as in a full upright and a fully reclined position. A portion of a pivotal chair seat support member is a curved flange that is provided with a plurality of spaced openings. The chair control housing contains a lock block slidably supported on guides. An actuator shaft attached to the chair control housing has a cam member attached to the shaft. A quarter turn of the actuator shaft causes the cam member to move the lock block to a forward position adjacent the curved flange. With the lock block in the forward position, one of a plurality of spring loaded pins in the lock block, is allowed to enter one of the openings in the curved flange thereby locking the chair support member of the chair into a predetermined tilt position. Reversal of the actuator shaft allows the lock block to move rearwardly and disengages the spring loaded pin from the opening in the curved flange and allows the tilt position of the chair to be changed by the user.

6 Claims, 5 Drawing Sheets

TILT CONTROL MECHANISM FOR CHAIRS

BACKGROUND OF THE INVENTION

This invention relates to a tilt control mechanism for a chair. It relates particularly to a knee tilt control mechanism for a pedestal type of office chair.

Chair controls are mechanical devices usually mounted beneath the seat of a chair to control the tilting of the chair when a user leans back in the chair. The control mechanism usually comprises a chair control housing adapted to be mounted on a support column attached to the chair pedestal base and a chair seat support member or plate secured to the underside of the chair seat and pivotally mounted to the chair control housing. There is usually a spring or other energy storing device attached to the chair control housing which controls the rate at which the user can tilt the chair rearwardly and which returns the chair to its upright at-rest position when the user stops leaning backward.

Many of the previously known chair controls have been pivoted at a point very near the center line of the chair control housing, which usually also coincides with the center of gravity of the user seated in the chair. As a result, the tilting of the chair backwards requires very little force, but raises the front of the chair seat, creating pressure on the back of the thighs and disturbing the blood circulation of the user. These chair controls also require the user to exert considerable force though an extension of the leg and foot to maintain a tilted position for this type of chair. The result is not relaxing to the user.

More recently there have been developed knee tilt chair controls. These knee tilt chair controls function to pivot the chair seat support member or plate as near to the natural knee joint of the user as possible so that the front of the seat rises very little or not at all during the rearward tilting of the chair. With a larger portion of the user's weight positioned behind the control pivot point, little or no effort is required to maintain the chair in a reclined position and the feet of the user can remain flat on the floor with no effort.

The knee tilt control chairs, as compared to the traditional controlled chairs, generally require a much greater force to support the user on the extended moment arm and to return the reclined user to an upright position. Springs providing such force tend to become quite large and bulky. The spring arrangements for knee tilt control chairs have usually dictated that the chair could be locked by the user only in a fully upright or a fully reclined position. Intermediate tilt positions could only be maintained by the user of a knee action control chair by applying sufficient restraining force against the spring through the legs and feet of the user making it difficult and uncomfortable for most users.

SUMMARY OF THE INVENTION

It is therefore an object of this invention to provide a tilt control mechanism for a knee tilt chair that permits the chair to be locked in a number of incremental tilt positions as well as a fully upright and a fully reclined position.

It is another object of this invention to provide a tilt control mechanism for a knee tilt chair that offers a greater degree of comfort to the user than previous tilt control chairs.

It is a still further object of this invention to provide a tilt control mechanism for a knee tilt chair that is easily adapted to a variety of knee tilt chairs, is attractive in appearance, is reliable and is capable of being produced at a reasonable cost.

It has been discovered that the foregoing objects can be attained by a chair tilt control for a pedestal base chair, comprising a chair control housing mounted on the pedestal chair base and pivotally supporting a chair seat support member. The chair seat support member has a curved portion that is provided with a plurality of spaced openings. The chair control housing contains a pair of guide members mounted parallel to each other on the housing and adapted to support a movable lock block. A rotary control lever shaft, supported by the housing, has a cam member attached to the control lever shaft. Rotation of the control lever shaft lever causes the cam member to move the lock block to a position against the curved portion of the chair seat support member. The movable lock block contains a plurality of spring loaded pins which are arranged in relation to the spaced openings of the curved portion of the housing so that one of the pins will fit into one of the spaced openings in the curved portion of the chair seat support member for a predetermined amount of tilt imposed on the chair by the user and thereby hold the chair locked in the desired degree of tilt until released by the user.

DESCRIPTION OF THE PREFERRED EMBODIMENTS

Figure 1:
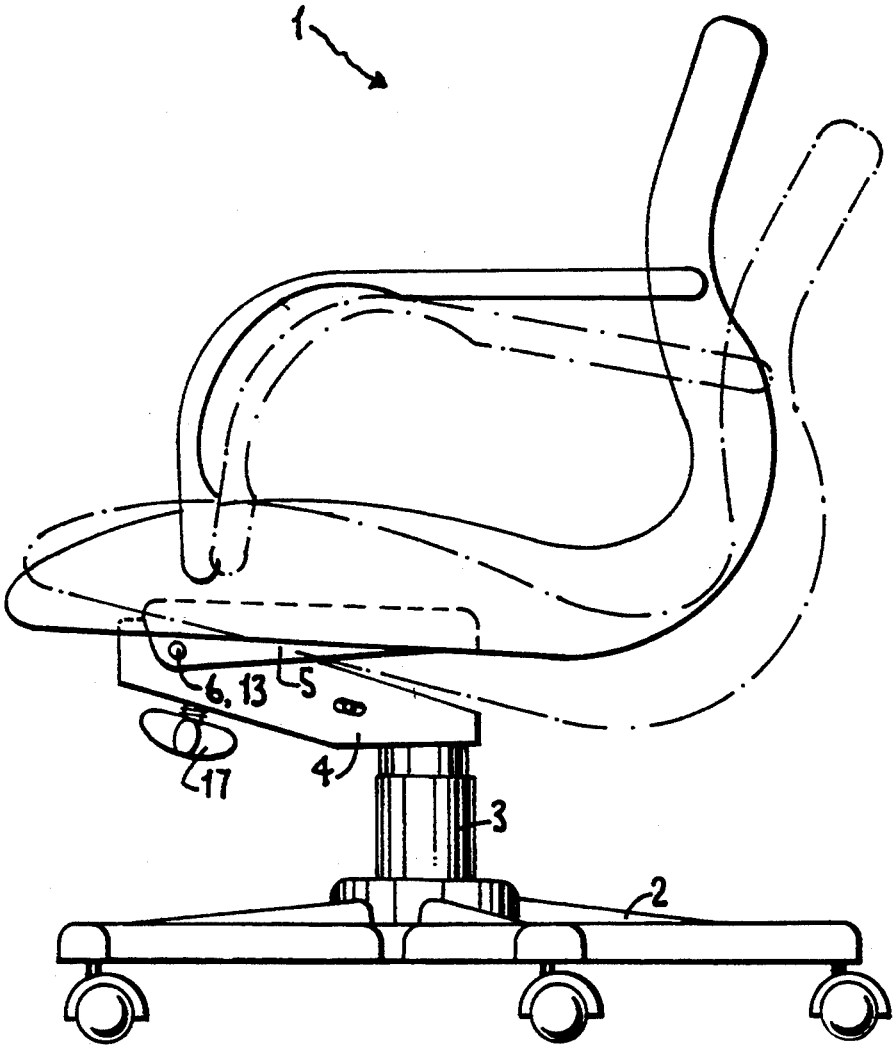
FIG. 1 is a side elevational view of a pedestal type of office chair with the tilt control mechanism of this invention.

FIG. 1 illustrates a side elevational view of a typical knee tilt office chair 1 having a pedestal base 2, a support column 3, a chair control housing 4 and a tiltable chair seat support member 5 pivotally connected to the chair control housing 4 by a pivot pin or pins 6. The chair control housing 4 is provided with a rotary control handle 17 for adjusting the tension on a torsion spring 16 that controls the rate at which the user can tilt the chair seat and the chair seat support member 5 about the pivot pin or pins 6 and which returns the chair 1 to an upright, at-rest position when the user stops leaning backward.

Figure 2:
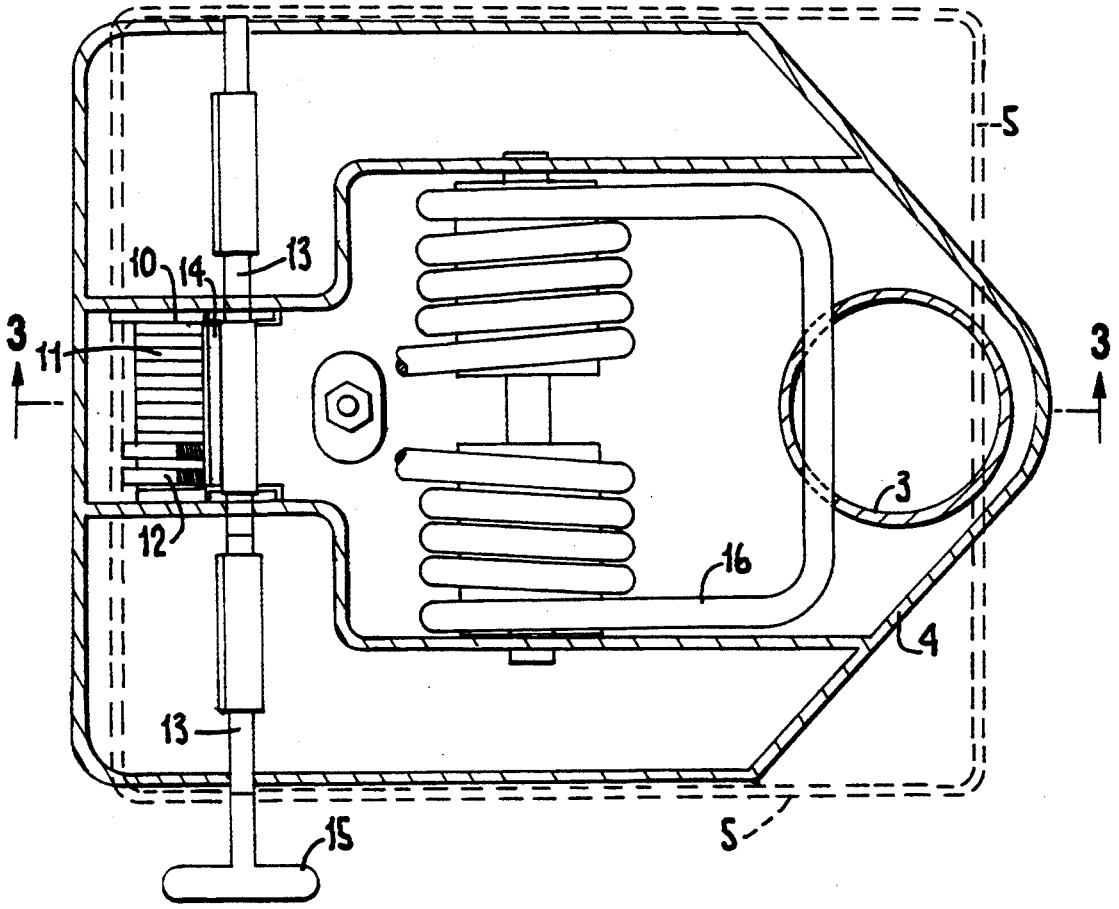
FIG. 2 is a top view of the tilt control mechanism of this invention with the chair seat support member shown in phantom.
Figure 3:
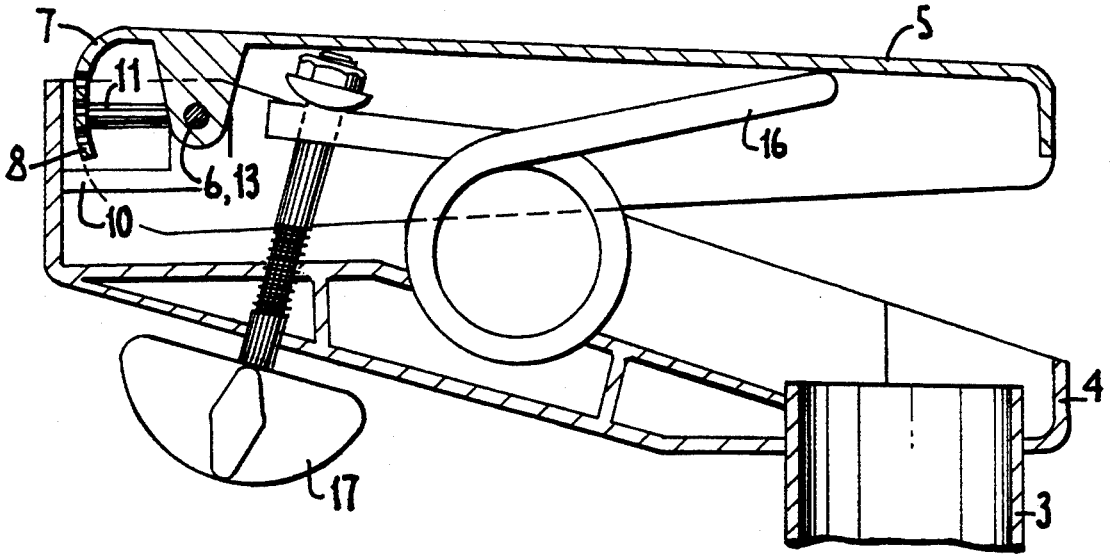
FIG. 3 is a sectional view of the tilt control mechanism of this invention taken along section lines 3—3 of FIG. 2.

FIG. 2 illustrates a top view of a preferred embodiment of the tilt control mechanism of this invention with the chair seat support member 5 shown in phantom. FIG. 3 is a sectional view of the tilt control mechanism of this invention taken along section lines 3—3 of FIG. 2.

Figure 9:
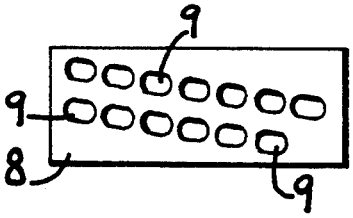
FIG. 9 is a front view of a chair seat support member illustrating a typical arrangement of openings in the front flange thereof for a preferred embodiment of this invention which will provide the ability to lock the chair in any one of thirteen degrees of tilt.

As illustrated in FIGS. 2 AND 3, the front portion 7 of the chair seat support member 5 is a curved flange 8, shown in a side view in FIGS. 3–6, and in a front view in FIG. 9. The curved flange 8, as part of the chair seat support member 5, rotates about the a hollow pivot pin 6 and is provided with a plurality of oval or elongated openings 9 arranged in a staggered pattern corresponding to the number of tilt lock positions desired. The openings 9 are offset from each other both laterally and vertically, as illustrated in FIG. 9, which provides for locking the chair in thirteen different tilt positions within a relatively small reclining angle range, for the embodiment illustrated.

Figure 4:
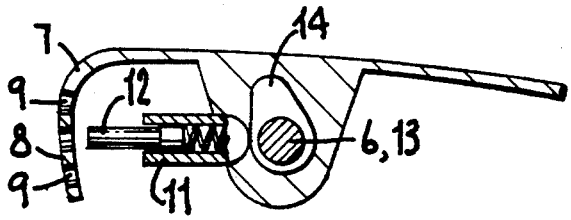
FIG. 4 is enlarged partial sectional view of the tilt control mechanism of this invention in an unlocked mode.
Figure 7:
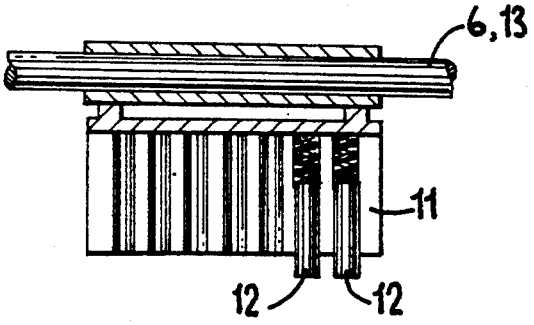
FIGS. 7 and 8 are enlarged partial sections of the lock block used in the tilt control mechanism of this invention.
Figure 8:
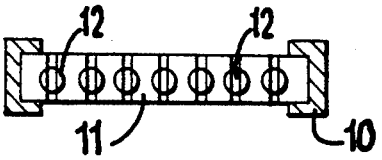

A pair of guide members 10 are mounted to the chair control housing 4, parallel to each other and are adapted to support a movable rectangular lock block 11. The lock block 11 is drilled to receive a plurality of spring loaded pins 12, which as illustrated in FIGS. 7 and 8, are seven in number for this embodiment. As illustrated in FIGS. 2–4, the chair control housing 4 also supports a horizontal rotary actuator shaft 13 parallel to and just behind the lock block 11 and which is able to rotate within the hollow pivot pin 6. The actuator shaft 13 has a handle 15 positioned to the side of the chair 1 and a cam member 14 secured to the actuator shaft 13. The cam member 14 is positioned and adapted to contact the back of the lock block 11 and slide the lock block 11 along the guide members 10 to a forward position adjacent to the curved flange 8 with a quarter turn of the actuator shaft 13 by the user operating handle 15.

Figure 5:
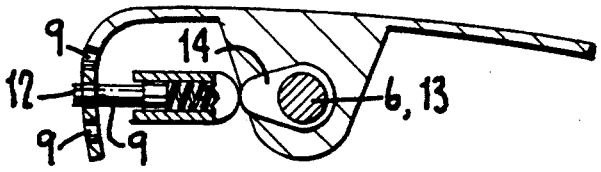
FIG. 5 is an enlarged partial sectional view of the tilt control mechanism of this invention in a locked mode.
Figure 6:
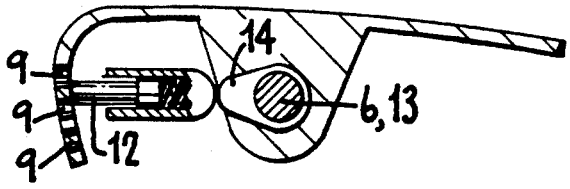
FIG. 6 is an enlarged partial sectional view of the tilt control mechanism of this invention in a locked mode but with the section taken at a different portion of the lock block than that shown in FIG. 5.

When the lock block 11 is in the forward position as illustrated in FIGS. 5 and 6, one of the spring loaded pins 12 will become aligned with and enter one of the openings 9 in the curved flange 8, as illustrated in FIG. 5. The rest of the spring loaded pins 12 are unable to align with an opening 9 and remain compressed in the lock block 11 by the unperforated surface of the curved flange 8 as illustrated in FIG. 6. The pin 12, which became aligned with and entered the opening 9, effectively locks the chair seat support member 5 from any further movement about the pivot pin 6.

To unlock the chair 1 from the above tilt lock position, the user turns the horizontal actuator shaft 13 a quarter turn in the reverse direction with handle 15 causing the cam member 14 to rotate away from the back of the lock block 11. The compressed springs in the pins 12 force the lock block 11 away from the curved flange 8 and extracts the single pin 12 from the opening 9 in which it had been previously engaged.

The chair 1 can then be raised or reclined by the user to a different tilt position as desired, and locked in place repeating the above-described procedure.

In this embodiment, there is provided seven spring loaded pins 12 in the lock block 11 and thirteen elongated openings 9 in the curved flange 8, which will provide up to thirteen different degrees of tilt to the chair 1 of this embodiment. The number of openings 9 and the number of spring loaded pins 12 can be varied as desired to produce more or less intermediate tilt positions but may be governed by the space available in the chair seat support member 5 or the chair control housing 4. While this embodiment illustrates the tilt control mechanism of this invention positioned to the front of the chair, it could also be positioned to the rear of the chair, if desired.

As a result of this invention as described above, I have provided a chair tilt control mechanism that is easy for the user to operate, permits the chair to be locked in a number of incremental tilt positions, as well as a full upright and a full reclining position, and provides a greater degree of comfort to the chair user. In addition, the chair tilt control mechanism of this invention can be easily adapted to a variety of knee tilt chairs, is attractive in appearance and is capable of being produced at a reasonable cost.

It is understood that this embodiment is just one example of the tilt control mechanism of this invention and is provided for purposes of illustrating this invention and not for the purpose of limitation.

I claim:

1. A chair tilt control for a pedestal base chair comprising a chair control housing mounted on the pedestal chair base and pivotally supporting a chair seat support member, said chair seat support member having a curved flange portion provided with a plurality of spaced openings, a pair of guide members mounted parallel to each other on said housing and adapted to support a movable lock block, a rotary actuator shaft supported by said housing, said shaft having a cam member adapted to move said lock block to a position adjacent to said curved flange portion of said chair seat support member upon rotation of said shaft, said lock block containing a plurality of spring loaded pins, one of said pins adapted to fit into one of said spaced openings in said curved flange portion of said chair seat support member for a predetermined degree of tilt imposed on said chair.

2. The chair tilt control of claim 1 in which the spaced openings are arranged in a staggered pattern.

3. The chair tilt control of claim 1 in which the spaced openings are arranged in two rows.

4. The chair tilt control of claim 1 in which the spaced openings are offset from each other both laterally and vertically.

5. The chair tilt control of claim 1 in which the spaced openings are oval in shape.

6. The chair tilt control of claim 1 in which said curved flange of said chair seat support member is towards the front of the chair.

* * * * *